US008413475B2

(12) United States Patent
Genet et al.

(10) Patent No.: US 8,413,475 B2
(45) Date of Patent: Apr. 9, 2013

(54) ROLLING FLUIDS

(75) Inventors: Nicole Genet, Villeurbanne (FR); Frédéric Jarnias, Saint Just Chateyssin (FR)

(73) Assignee: Total Raffinage Marketing, Puteaux (FR)

( * ) Notice: Subject to any disclaimer, the term of this patent is extended or adjusted under 35 U.S.C. 154(b) by 0 days.

(21) Appl. No.: 13/381,216

(22) PCT Filed: Jul. 2, 2010

(86) PCT No.: PCT/IB2010/053055

§ 371 (c)(1), (2), (4) Date: Dec. 28, 2011

(87) PCT Pub. No.: WO2011/001414

PCT Pub. Date: Jan. 6, 2011

(65) Prior Publication Data

US 2012/0111079 A1 May 10, 2012

(30) Foreign Application Priority Data

Jul. 3, 2009 (FR) ..... 09 03277

(51) Int. Cl.
*C10M 105/38* (2006.01)
*C10M 115/08* (2006.01)

(52) U.S. Cl. ..... 72/42; 508/463; 508/552; 44/369; 44/386; 44/408

(58) Field of Classification Search ..... 44/369, 44/386, 408, 410, 418; 508/110, 382, 463, 508/552, 556, 563; 72/42
See application file for complete search history.

(56) References Cited

U.S. PATENT DOCUMENTS

| | | | | |
|---|---|---|---|---|
| 3,121,678 | A | 2/1964 | Behymer et al. | |
| 4,889,648 | A | 12/1989 | Higaki et al. | |
| 6,270,538 | B1 * | 8/2001 | Ledeore et al. | 44/386 |
| 6,843,087 | B2 | 1/2005 | Prince et al. | |
| 7,932,217 | B2 * | 4/2011 | Hee et al. | 508/110 |
| 2008/0248981 | A1 | 10/2008 | Matsui et al. | |
| 2009/0111723 | A1 | 4/2009 | Shibata et al. | |
| 2010/0093568 | A1 | 4/2010 | Tagawa et al. | |
| 2010/0137176 | A1 | 6/2010 | Aoki et al. | |

FOREIGN PATENT DOCUMENTS

| | | |
|---|---|---|
| GB | 1 369 515 | 10/1974 |
| JP | 2007-154055 | 6/2007 |
| WO | WO 98/04657 | 2/1998 |
| WO | WO 03/074634 | 9/2003 |
| WO | WO 03/074635 | 9/2003 |

* cited by examiner

*Primary Examiner* — David B Jones

(74) *Attorney, Agent, or Firm* — Harness, Dickey & Pierce, P.L.C.

(57) ABSTRACT

The disclosure relates to a cold rolling fluid, including: (a) a hydrocarbon base including at least 50 wt % of isoparaffins; (b) one or more frictional modifiers selected from among fatty alcohols, fatty acids, fatty amines, fatty acid esters, or polymer esters resulting from the esterification of alpha-olefin copolymers and dicarboxylic acids using alcohols; and (c) one or more phosphorous anti-wear and/or extreme pressure additives. The disclosure also relates to an emulsion containing the rolling fluid and to the use of the rolling fluid for cold-rolling steel.

16 Claims, 1 Drawing Sheet

DIAGRAM OF THE GAP: ENTRY, WORKING AND EXIT ZONES

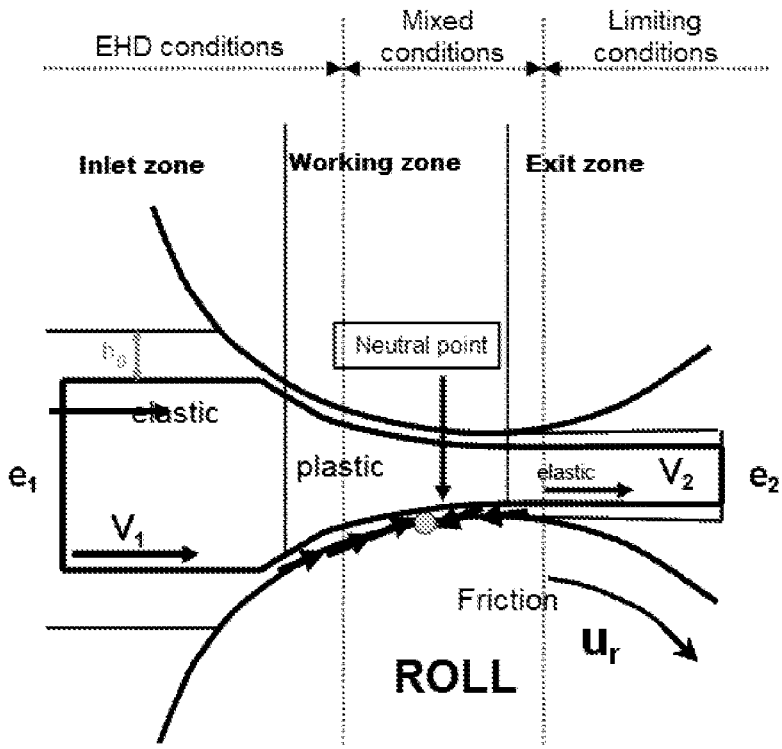
FIGURE 1 : DIAGRAM OF THE GAP: ENTRY, WORKING AND EXIT ZONES
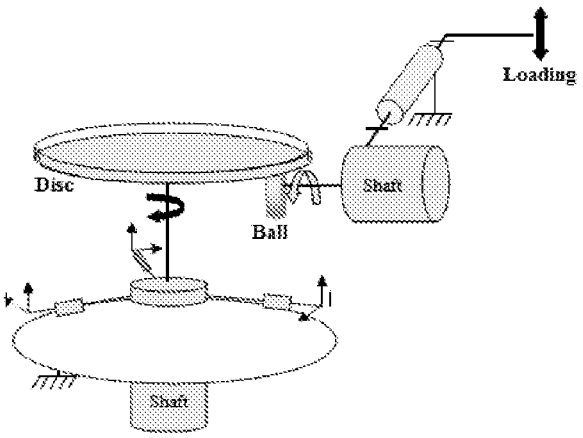
FIGURE 2 : EHD BALL-ON-DISC TRIBOMETER: LOCATION OF THE FORCE SENSOR

ROLLING FLUIDS

CROSS-REFERENCE TO RELATED APPLICATIONS

This application is a National Phase Entry of International Application No. PCT/IB2010/053055, filed on Jul. 2, 2010, which claims priority to French Patent Application Serial No. 09/03277, filed on Jul. 3, 2009, both of which are incorporated by reference herein.

FIELD

This invention relates to oils for the cold rolling of steel, in particular austenitic and ferritic steel.

BACKGROUND AND SUMMARY

Rolling is an operation for the shaping of metals by plastic deformation. It is intended to reduce the thickness of a strip by passing it through two or more pairs of axially symmetrical tools rotating about their axes (typically rolls). Their rotation draws the product through by friction in the gap provided by the entry, working and exit zones. Longitudinal tensile forces (on exit) and opposing tensile forces (on entry) applied simultaneously can be used to reduce the normal force imposed by the rolls (gripping force).

After passing through hot rolling, cold rolling can be used to provide a product with a precise geometry, controlled mechanical and metallurgical properties and a well-controlled surface condition. The roughness obtained results from transfer of the roughness of the tool onto the strip. It is highly dependent on lubrication. Some strips have to be delivered bright, therefore smooth (with a roughness of close to 0.2 μm). In order to manufacture a smooth strip ground or even polished rolls are used, together with a low viscosity lubricant. The surface conditions of rolled strips may show irregularities, for example gouges resulting from local breakdown of the lubricant film causing metal particles to be torn off and adhere to the rolls.

From a chemical point of view, corrosion phenomenon may appear. The presence of reactive films or contamination of the strips by lubricants from previous operations are also difficulties which have to be overcome. Residues may mark the surface when rolled strip is annealed.

FIG. 1 shows a metal strip at the entry to a rolling mill. In the entry zone the strip of initial thickness $e_1$ is drawn in at a speed $v_1$ by two rolls. It is plastically deformed in the working area and leaves the roll gap with a thickness $e_2$. Because the quantity of material is conserved, the strip is accelerated in the gap as it is reduced and elongates. Thus the exit speed $v_2$ of the strip is faster than the entry speed $v_1$. The level of reduction is defined by $r=(e_1-e_2)/e_1$. In an normal rolling pass there is a "neutral point" in the gap where the peripheral speed of the rolls is the same as the local speed of the strip. Its position will depend on the longitudinal tensions applied to the strip, the friction conditions, the reduction and the rolling speed.

Thus except for small zone around the neutral point there is relative slip between the strip and roll in the gap, and therefore friction and shear stresses at the interface. Upstream from the neutral point the rolls tend to draw the strip into the gap, friction is the driver.

The friction must be sufficient to allow the strip to be effectively fed into the gap, but not excessive in order to avoid any sticking or problems with surface condition. It is essential that a lubricant should be present to control friction and as a consequence irregularity in the thickness and surface condition of the strip. It is therefore important that lubricant behaviour should be well controlled at the scale of the contact between the rolls and the strip for the better control of friction during cold rolling.

Upstream of the neutral point the rolls tend to draw the strip into the gap, friction is the driver. Mixed elastohydrodynamic (EHD) friction conditions are found in this upstream zone: in the more upstream zone the lubricant film is continuous, wear is low, there is no contact between the rough points on the two opposing surfaces, but pressures generated in the film are sufficiently high to cause significant elastic deformation of the surfaces. The type of friction generated in this zone can be reproduced in an EHD ball-on-disc tribometer.

Downstream of the neutral point slip opposes advancement of the strip: friction provides resistance. Limiting friction conditions prevail in this zone. Unlike in EHD lubrication, limiting lubrication is a regime in which friction and wear of the two surfaces in relative movement are jointly determined by the properties of the solid surfaces and those of the lubricant. Thus the thickness and nature of the oxide layers, the creation of fresh surface and its reactivity to components of the lubricants, in particular additives, have an enormous effect on friction. This type of friction can be reproduced in a Cameron Plint cylinder-on-flat tribometer.

The behaviour of rolling fluids upstream and downstream of the neutral point (in the gap) is mainly governed by the bases and fatty substances in the upstream part, where EHD and mixed friction conditions prevail. The addition of additives, in particular extreme pressure additives, together with the bases and fatty substances, makes a significant contribution to the performance of these fluids in the downstream part, where limiting lubrication conditions exist. Work on rolling oils essentially relates to the nature of the fatty substances or synthetic esters added to the compositions. Fluids in the prior art are not optimised in respect of bases and additives.

Thus application EP 1 123965 describes a fluid for the cold rolling of steel comprising a naphthenic or paraffinic base oil, which may or may not be hydrocracked, which may have been freed of aromatics using solvent or by hydrotreating, the viscosity of which can be adjusted by kerosene cuts and from 1 to 80% di(2-ethylhexyl)adipate as the fatty body. The composition may also contain phosphorus-, sulphur- or phosphorus/sulphur-containing anti-wear and extreme pressure additives. Patent EP 0242 925 describes rolling fluids containing esters of amino alcohols and fatty acids comprising at least 6 carbon atoms. No extreme pressure additives are disclosed in this document, and no information is provided about the nature of the mineral bases employed in the said fluids.

No specific choice of bases or additives is made in the rolling fluids of the prior art to ensure optimum friction properties under EHD and/or limiting conditions. It follows that reducing the thickness of strip by a particular amount requires a number of rolling passes with these fluids. Use of these fluids according to the prior art may also result in sticking, which means that rolling can no longer take place, or microsticking which has an adverse effect on surface condition.

There is therefore a need for oils which can improve the productivity of rolling mills, for example by reducing the number of passes required in order to obtain a given amount of reduction without sticking or microsticking which might have an adverse effect on the surface condition and in particular the brightness of the strips. Rolling fluids according to the invention have friction coefficients under elastohydrodynamic conditions that are significantly lower on steel surfaces than those of the lubricants currently used in cold rolling. Thus, the neutral point is moved downstream, which results in higher levels of reduction per pass and makes it possible to reduce the total number of passes in order to achieve a given amount of reduction. This can improve the performance of the rolling mill.

In particular, when they contain phosphorus- and/or phosphorus/sulphur- and/or sulphur-containing extreme pressure additives fluids according to the invention also have friction properties under limiting conditions on steel surfaces which are superior to those of the fluids in the prior art. In fact, friction coefficients obtained on a Cameron Plint tribometer using such fluids according to the invention show that on ferritic and austenitic steel surfaces significantly lower friction coefficients are obtained up to higher temperatures and under higher loads (thus under more severe friction conditions) than with commercial lubricants for the cold rolling of steel.

Under heavy load commercial lubricants give rise to immediate sticking, whereas using lubricants according to the invention friction is observed under heavy load up to temperatures of the order of 100° C. Thus, the risks of sticking are considerably reduced and heavier loads can be applied to the rolls and large reductions in thickness can be obtained with a smaller number of passes. This further helps to improve the efficiency of rolling mills, and also improves the surface condition of the rolled strip. This is more advantageous in that these very good properties can be obtained with rolling fluids according to the invention which have a low sulphur content, or are even sulphur-free.

Additives containing sulphur have a very effective action on friction properties, particularly under limiting conditions, but have a tendency to form iron sulphide on the fresh surfaces produced by rolling, which results in the strips becoming marked. These marks can be removed by annealing at 1200° C. in the case of austenitic steel but H2S is formed, causing corrosion of furnace refractories. In the case of ferritic steel annealing at 900° C. is insufficient to remove marks.

Rolling fluids according to the invention containing particular phosphorus-containing additives in possible combination with phosphorus/sulphur- and/or sulphur-containing additives have very good friction properties with low levels of sulphur, and even in the absence of sulphur. Thus, according to one embodiment rolling fluids according to the invention can increase the efficiency of rolling mills and improve the surface condition and therefore the brightness of rolled strip, avoiding the risk of marking the strip.

This invention relates to a cold rolling fluid comprising:

(a) a hydrocarbon base comprising at least 50% by weight of isoparaffins, (b) one or more fatty substances, preferably selected from the esters of fatty acids, or polymer esters obtained by the esterification of alpha olefin and dicarboxylic acid copolymers by alcohols.

Preferably, in the rolling fluid according to the invention the hydrocarbon base (a) comprises at least 60% by weight of isoparaffins. Preferably, in the fluid the hydrocarbon base (a) comprises petroleum cuts having an initial and final distillation point of between 200 and 400 measured according to ASTM D86, comprising hydrocarbon molecules having between 13 and 25 carbon atoms. Preferably, hydrocarbon bases (a) have an aromatics content of not more than 100 ppm, and a sulphur content of not more than 1 ppm measured according to ASTM D2622.

According to one embodiment the fluid according to the invention also comprises:

(c) one or more phosphorus- and/or phosphorus/sulphur- and/or sulphur-containing anti-wear and/or extreme pressure additives.

Preferably, the rolling fluid according to the invention has a sulphur content of less than 1100 ppm according to standard ASTM D 2622, preferably less than 1000 ppm, preferably less than 500 ppm.

According to a preferred embodiment, the rolling fluid according to the invention comprises one or more organophosphorus compounds derived from phosphoric and/or phosphorous acids as compound (c), the said fluid having a phosphorus content measured according to standard NFT 60-106 of at least 500 ppm, with the condition that when the said fluid only contains phosphoric acid derivatives by way of compound(s) (c) it contains at least one sulphur- or phosphorus/sulphur-containing compound and its sulphur content measured according to ASTM standard D2622 is at least equal to 300 ppm. According to a preferred variant the rolling fluid according to the invention comprises at least one phosphorous acid derivative by way of compound (c) and a sulphur content of less than 300 ppm when measured according to ASTM D2622.

Preferably, the VI (viscosity index) of the rolling fluid according to the invention measured according to ASTM standard D2270 is greater than 110, preferably greater than 120, preferably greater than 130. Its kinematic viscosity at 100° C. measured according to ASTM D445 preferably between 2 and 3, preferably between 2.5 and 2.65 cSt. Its kinematic viscosity at 40° C. measured according to ASTM D445 is preferably between 7.5 and 9, preferably between 7.6 and 8.8 cSt.

According to one embodiment the rolling fluid according to the invention comprises:

- 50 to 90% by weight of a hydrocarbon base (a)
- 5 to 20% by weight of one or more fatty substances (b)
- 0.5 to 7% by weight of one or more organophosphorus compounds derived from phosphoric and/or phosphorous acids (c).

According to one embodiment the rolling fluid according to the invention may also comprise 1 to 20% by weight of one or more surfactants, preferably selected from non-ionic or anionic surfactants.

The present invention also relates to an aqueous emulsion comprising the latter rolling fluid. The present invention also relates to use of a rolling fluid or an aqueous emulsion according to the invention for the cold rolling of steel, preferably austenitic or ferritic steel.

DRAWINGS

The drawings described herein are for illustrative purposes only of selected embodiments and not all possible implementations, and are not intended to limit the scope of the present disclosure.

FIG. 1 is a diagram of a metal strip at the entry to a rolling mill; and

FIG. 2 is a diagram of the device and the positions of the sensors.

DETAILED DESCRIPTION

Hydrocarbon Bases

The hydrocarbon bases for rolling fluids impart the essential features of their friction properties to the said fluid, in combination with the fatty acids, in the entry zone to the rolling mill, where EHD conditions prevail. These properties can be improved through the action of additives. These bases also impart the properties of fluidity and volatility required for cold rolling applications to the fluid. In fact, the rolling fluid must be capable of being easily removed at temperature in annealing operations, and must also first be capable of being largely removed while the strip is wound into coils. Hydrocarbon bases currently used in rolling fluids are lubricant bases of mineral origin (obtained from petroleum cuts) which may be paraffinic or naphthenic, hydrocracked or not hydrocracked.

The paraffin bases used in rolling fluids according to the prior art are obtained from vacuum distillates solvent refined to remove aromatics and some of the n-paraffins. Some paraffin bases may undergo hydrotreating to reduce their aromatics content (these will be converted into naphthenes). These bases have not undergone any specific conversion process for the n-paraffins (of the hydrodewaxing or hydroisomerisation or hydrodeparaffining type), and their isoparaffins content is substantially that of the starting crudes. They are most often described by the name of "neutral solvent" or neutral "hydrotreated" paraffin bases and typically contain of the order of 55% of paraffins, of which approximately half are isoparaffins.

The naphthenic bases used in rolling fluids according to the prior art are very often obtained from hydrocracked gas oil fractions. Typically gas oil fractions are defined as petroleum cuts having initial and final distillation points of between 200 and 400 measured according to ASTM D86, comprising hydrocarbon molecules having between 13 and 25 carbon atoms. These naphthenic bases have a high naphthenes content (of the order of 45% or 60% or 70% by weight or more) and a paraffins content of the order of 20 to 55% by weight, of which 15 to 30% are isoparaffins. Such bases are for example described in applications WO 03/074634 and WO 03/074635.

The rolling fluids according to the invention comprise by way of constituent (a) a hydrocarbon base comprising at least 50% by weight of isoparaffins, preferably at least 60% by weight, even more preferably at least 65% by weight. This constituent (a) may be obtained from a single base or using several bases leading to a mixture comprising at least 50% by weight of isoparaffins, preferably at least 60% by weight, even more preferably at least 65% by weight. Constituent (a) of the fluids according to this invention may therefore have a high concentration of isoparaffins, unlike the mineral bases currently used in cold rolling fluids.

Preferably, the said hydrocarbon bases (a) comprise less than 10% by weight of n-paraffins, or again less than 7% by weight of n-paraffins. A low concentration of n-paraffins has a favourable effect on the pour point. Said bases preferably have a pour point of less than −15° C. according to ASTM D97, preferably less than −20° C. This imparts very good stability during storage to the rolling fluids according to the invention.

The kinematic viscosity of these bases at 40° C. is preferably between 6.5 and 8 cSt, preferably between 7 and 7.8 cSt, and their kinematic viscosity at 100° C. preferably lies between 2 and 3 cSt, preferably between 2 and 2.5 cSt. Their VI (for bases having a KV100 of more than 2) is generally over 100, preferably of the order of 105, 108 or more. Preferably, hydrocarbon base (a) comprises petroleum cuts having an initial and final distillation point of between 200 and 400 measured according to ASTM D86 and comprising hydrocarbon molecules having between 13 and 25 carbon atoms (gas oil cuts). Preferably, these are hydrodeparaffinated gas oil cuts in which the n-paraffins have been converted into isoparaffins, the said gas oil cuts having possibly been purified with a view to removing sulphur or aromatic hydrocarbons, and may possibly have been redistilled.

The total paraffins content (isoparaffins and normal paraffins) of the hydrocarbon bases used in the compositions according to the invention is measured by mass spectrometry according to ASTM standard D2786. This method can be used to distinguish 7 families of hydrocarbons—paraffins, naphthenes containing 1, 2, 3, 4, 5, 6 rings—in petroleum cuts having a mean number of carbon atoms between 16 and 32. The n-paraffins content of these bases is measured by gas chromatography on a non-polar column using an on-column type injector and an FID detector. The samples are first diluted in carbon disulphide. The aromatics content is measured by UV absorption spectrometry. The isoparaffins content of the bases is then calculated by difference from the total paraffins content according to ASTM D 2786.

For environmental and safety reasons it is desirable that these hydrocarbon bases should have a low aromatics content (typically less than 100 ppm) and a low sulphur content (less than 10 ppm, typically less than 1 ppm). For this purpose they may undergo purification stages typically comprising stages of hydrodesulphurisation or hydrogenation in order to reduce the sulphur content and remove aromatic or unsaturated cyclic products by converting them into naphthenes. The hydrocarbon bases used in compositions according to the invention preferably have an aromatics content of less than 1000 ppm and a sulphur content of less than 1 ppm measured by ASTM D 2622.

The hydrocarbon bases used in compositions according to the invention contribute to their very favourable properties (very low friction coefficients) under EHD conditions, in combination with the fatty substances. In addition to this, the use of hydrocarbon bases having a high isoparaffins content helps to maintain a sufficient oil film thickness regardless of the rolling temperature. In cold rolling the mean temperature is of the order of 100° C., but may reach a temperature peak of the order of 170° C. in the case of austenitic steels and of the order of 130° C. in the case of ferritic steels. The rolling temperature can be considered to lie between 50 and 180° C.

A minimum oil film thickness helps to prevent sticking and microsticking. Thus, when rolling fluids according to the invention are used it is found that there is no sticking under heavy load at very much higher temperatures than when using fluids according to the prior art. The bright appearance of the rolled strip with the fluids according to the invention may also be explained by a reduction in microsticking, without this being binding upon the applicant.

Fatty Substances

The fatty substances or friction modifiers used in the rolling fluids according to the invention have the function of protecting the surfaces rubbing against each other by forming a film adsorbed onto the surface. They contribute to the friction properties of the rolling fluids under EHD conditions. These fatty substances may be fatty alcohols, fatty acids, natural or synthetic fatty esters and fatty amines, preferably esters.

By way of example mention may be made of fatty substances of plant and animal origin, fatty acids containing between 10 and 22 or between 12 and 18 carbon atoms, in particular lauryl alcohol, fatty acids such as capric, lauric, myristic, stearic, oleic or linoleic acids, esters of fatty acids and monoalcohols or polyols, for example trimethylolpropane, pentraerythritol, 2-ethylhexyl alcohol, glycerol, for example glycerol monooleate, trimethylolpropane trioleate, petraerythritol tetraoleate. Various synthetic compounds, in particular synthetic esters such as the acids of amino alcohols and fatty acids described in patent EP 0242925, di(2-ethylhexyl)adipate, etc., may also be used.

The polar nature of these fatty substances (esters, alcohols) can also dissolve the additives included in rolling fluid formulations. They can also be used to adjust the viscosity of rolling fluids to the required level. Rolling fluids according to the invention thus preferably have a kinematic viscosity at 40° of between 7.5 and 9 cSt, preferably between 7.6 and 8.9, or again between 8.3 and 8.8 cSt, or between 8 and 8.8 cSt. Their kinematic viscosity at 100° C. is preferably between 2 and 3 cSt, preferably between 2.3 and 2.5 cSt or again between 2.5 and 2.6 cSt. The kinematic viscosities at 40 and 100° C. are measured according to ASTM D445.

The fatty substances preferably selected for rolling fluids according to the invention are esters providing a VI (viscosity index) over and above that of the strongly isoparaffinic bases described above. In particular fatty acid esters, for example mono-, di- or triesters of polyols, preferably neopolyols, preferably trimethylolpropane and petraerythritol, and fatty acids comprising between 10 and 22 carbon atoms, or synthetic esters, also known as polymer esters, obtained by esterifying copolymers of alpha olefins and dicarboxylic acids by alcohols, are in particular preferably used in this invention. The use of these esters, and in particular polymer esters, makes it possible to increase the residual viscosity of the rolling fluid according to the invention under high mechanical or thermal stresses: these fatty substances remain on the strip under these extreme conditions whereas the hydrocarbon base part is more volatile, and furthermore they act as a vector for additives.

A high VI indicates a tendency for the fluid to remain at a stable viscosity as temperature varies. The VI is measured according to ASTM D2270, from kinematic viscosities measured at 40 and 100° C. according to ASTM D445. Thus, the isoparaffin bases alone have a VI of the order of 100 to 110, whereas the VI of the rolling fluids according to the invention is above 110, preferably above 120, 125 or 130, or 140 or more. As for known commercial fluids, these have very much lower VI, of the order of 70 to 80. A high VI helps to ensure a minimum film thickness whatever the rolling temperature.

The preferred fatty substances for the rolling fluids according to the invention provide very good friction properties under EHD conditions, in combination with the isoparaffin bases, and a high VI, ensuring a sufficient oil film thickness regardless of the rolling temperature. In combination with the anti-wear and extreme pressure additives, this helps to provide fluids which can improve the efficiency of rolling mills, rolling without risk of sticking or microsticking, and therefore making it possible to improve the surface condition of the rolled strip.

These fatty substances preferably constitute of the order of 5 to 25% by weight, preferably from 7 to 20% or from 10 to 18% by weight of the rolling fluids according to the invention. Too low a concentration does not in general offer a significant effect, a higher concentration generally leads to excessively high viscosities and/or difficulty in removing the fluids after rolling operations. However other quantities may be determined by a person skilled in the art.

Extreme Pressure and Anti-Wear Additives

Extreme pressure properties indicate the ability of lubricants to protect surfaces against sticking under very severe operating conditions from the tribological point of view: very high contact temperatures created by heavy loads associated with high slip speeds and/or load impacts. Extreme pressure (EP) and anti-wear additives act under the severe conditions (high load, limiting conditions). They form a tribochemical film protecting the metal surface through reaction of the additive or its decomposition products with the metal. Under the effect of the contact temperature the EP additives decompose chemically to release active elements such as sulphur or chlorine. These attack the metal at the rough points in contact to form in situ self-lubricating protective films comprising metal sulphides, chlorides or phosphides, characterised by low shear strengths.

Extreme pressure (EP) additives are mainly sulphur-, chlorine-, phosphorus- or phosphorus/sulphur-containing derivatives. Some chlorinated additives, for example chlorinated paraffins of medium chain length (between 14 and 17 carbon atoms), are also extreme pressure additives. Their use will be avoided in the fluids according to the invention, because of their toxicity. The anti-wear and/or extreme pressure additives used in the fluids according to the invention are preferably phosphorus- and/or sulphur- and/or phosphorus/sulphur-containing additives, for example such as those described below.

Examples of phosphorus-containing EP additives are for example alkyl phosphates or alkyl phosphonates, phosphoric acid, phosphorous acid, mono-, di- and triesters of phosphorous acid and phosphoric acid, and their salts, for example amine salts or zinc salts. By way of example mention may be made of alkyl or aryl phosphites or hydrogen phosphites, didodecyl phosphite, dilauryl hydrogen phosphite, di or tri trialkyl phosphates such as dilauryl phosphate, tri(2-ethylhexyl)phosphate, tricresyl phosphate, dialkyl (or diaryl)phosphates, and their salts, for example amine or zinc salts.

Examples of phosphorus/sulphur-containing anti-wear and extreme pressure additives are for example but not limited to thiophosphoric acid, thiophosphorous acid, esters of these acids, their salts, dithiophosphates, in particular zinc dithiophosphates. Examples of salts of esters of thiophosphoric acid and thiophosphorous acid are those obtained by reaction with a nitrogen-containing compound such as ammonia or an amine or zinc oxide or zinc chloride. As examples of sulphur-containing anti-wear and extreme pressure additives mention may be made by way of example of dithiocarbamates, in particular zinc dithiocarbamates, dimercaptothiadiazoles and benzothiazoles, mercaptobenzothiazole, sulphur-containing olefins (for example di-, tri-, pentasulphides), sulphur-containing fatty substances, for example esters, triglycerides, methyl esters or fatty acids, for example sulphur-containing oleic acid.

The additives containing sulphur have a very effective action on friction properties but have a tendency to form iron sulphide on the fresh surfaces created by rolling, which leads to marking of the strip, in particular during storage before coils of strip, which have a core temperature which can reach 140° C., are annealed. These marks may be removed in the case of austenitic steel by annealing at 1200° C., but H2S is formed and gives rise to corrosion of the furnace refractories. In the case of ferritic steel annealing at 900° C. will not remove the marks. It is therefore preferable to limit the sulphur content of cold rolling fluids while maintaining good friction performance, in particular under limiting conditions.

According to a preferred embodiment, the anti-wear and extreme pressure additives of fluids according to the invention are organophosphorus compounds, possibly in combination with phosphorus/sulphur and/or sulphur-containing compounds. These organophosphorus compounds which are preferably used in the fluids according to the invention are derivatives of phosphorous acid, namely phosphates or hydrogen phosphates or dihydrogen phosphates, designated generally below by the term "phosphates", or derivatives of phosphorous acid, namely phosphites or hydrogen phosphites or dihydrogen phosphites, designated below by the term "phosphites". Typically they are alkyl or aryl phosphates, hydrogen phosphates, dihydrogen phosphates, phosphites, hydrogen phosphites, dihydrogen phosphites.

Typically the alkyl chains contain between 10 and 22 and preferably 12 and 18 carbon atoms. These compounds are preferably present in the fluids according to the invention in quantities leading to a content of the element phosphorus measured according to NFT 60-106 of at least 500 ppm, preferably between 800 and 3000, preferably between 1000 and 2000 ppm, and ensure excellent friction performance for very low sulphur levels in the said fluid.

The applicant has found that organophosphorus compound derived from phosphorous acid ("phosphites"), which are more reactive as EP agents than those derived from phosphoric acid ("phosphates"), make it possible to achieve excellent friction performance in combination with the bases and fatty substances according to the invention, with a very low sulphur content, below 300 ppm, or again 200 or 150 ppm, or 50, or 10 ppm of sulphur, and even when they are sulphur-free. When phosphates alone are used, the sulphur content in the rolling fluid should however be at least 300 ppm, preferably between 500 and 1000 ppm or between 850 and 950 ppm. Typically sulphur levels in rolling fluids according to the invention measured according to ASTM D2622 are below 1100 ppm, preferably below 1000 ppm, preferably below 500 ppm, i.e. sulphur levels for which no marking of the strips is observed. In a preferred embodiment of the invention the rolling fluids contain derivatives of phosphorous acid and possibly sulphur- or phosphorus/sulphur-containing EP additives and have a phosphorus content measured according to NFT 60-106 of at least 500 ppm and a sulphur content measured according to ASTM D2622 of less than 300 ppm, preferably less than 200, 100, 50 ppm, even more preferably less than 10 or 1 ppm of sulphur, or are even more preferably sulphur-free.

Other Additives

Rolling fluids according to the invention may also contain any types of additives which are appropriate for their use, for example antioxidants, for example aminated or phenolic antioxidants, corrosion inhibitors, antifoaming agents, etc. The rolling fluids according to the invention may for example comprise between 0.05 and 1% by weight of an antioxidant, preferably a phenolic antioxidant. The rolling fluids according to the invention may for example comprise between 0.01 and 0.1 percent by weight or one or more anticorrosion additives, preferably a salt of phosphoric acid, preferably an amine phosphate.

Use

The rolling fluids according to the invention are particularly suitable for the cold rolling of steel strip, in particular austenitic and ferritic steel. Cold rolling is an additional thinning undergone by flat products (typically strip). It is preceded by hot rolling, which takes place at temperatures of the order of 800 to 1200° C. Cold rolling is performed at temperatures of the order of 40 to 180° C., and is designed to impart upon products a specific geometry (thickness, flatness), a microstructural condition and a surface condition appropriate for subsequent annealing treatments. For cold rolling operations the fluids according to the invention may be used in the form of oil only, or in the form of an oil-in-water emulsion.

The use of rolling fluids in the form of emulsions has the advantage of better heat removal (better temperature control) in the rolling process. Rolling fluids may also be found in the form of emulsions when lubricant alone is first used for the temporary protection of strip against corrosion. In such cases the strip is rinsed with water before rolling and the resulting effluent is recycled as a rolling fluid. This has an economic advantage as well as a lower environmental impact.

Use in the form of an emulsion requires the inclusion of surfactants. These surfactants may be all kinds of surfactants, preferably non-ionic surfactants such as fatty alcohols, fatty acids, fatty amines or methyl esters of fatty acids, ethoxylated surfactants, or anionic surfactants such as soaps, sulphonates, fatty acid sulphates.

The rolling fluids according to the invention which are intended to be emulsified contain between 1 and 20%, preferably between 1.5 and 5%, of such surfactants. These rolling fluids may have a relatively high antioxidant concentration, for example of the order of 0.2 to 1%, compared with of the order of 0.05% for fluids which are intended to be used in the form of oil only. This invention also relates to aqueous emulsions comprising these rolling fluids, preferably in a concentration of between 3 and 10% with respect to the total weight of emulsion.

Example 1

Preparation of Rolling Fluids

Several rolling fluids have been prepared using hydrocarbon bases obtained from petroleum cuts having initial and final distillation points between 270 and 380° C., fatty substances and extreme pressure additives. Base (a) of fluids A and B contains 67.8% by weight of isoparaffins, 5.5% by weight of n-paraffins, 26.7% by weight of naphthenes. Base (a) for fluids C and D contains 64.6% by weight of isoparaffins, 5.7% by weight of n-paraffins, 29.7% by weight of naphthenes. Base (a) for fluids E and F contains 62.5% by weight of isoparaffins, 5.7% by weight of n-paraffins, 31.8% by weight of naphthenes.

The compositions of these fluids by mass are shown in Table 1 below.

TABLE 1

| Composition of rolling fluids (% by mass) | | | | | | |
|---|---|---|---|---|---|---|
| | A | B | C | D | E | F |
| Base (a) | 82.40 | 82.35 | 82.40 | 82.30 | 87.00 | 84.30 |
| Antioxidant/ anticorrosion | 0.60 | 0.60 | 0.60 | 0.60 | 0.60 | 0.60 |
| Hydrogen phosphite | 2.00 | 2.00 | 2.00 | 2.00 | 2.00 | |
| Phosphate | | | | | | 0.15 |
| Ester of fatty acid and neopolyol | 15.00 | 15.00 | 15.00 | 15.00 | | 10.00 |
| Polymer ester | | | | | 10.00 | |
| Phosphorus/ sulphur-containing EP additive | | | | 0.10 | | |
| Sulphur-containing EP additive | | 0.05 | | | | 5.00 |
| Total | 100.00 | 100.00 | 100.00 | 100.00 | 100.00 | 100.00 |

These fluids were compared with a commercial rolling fluid containing a naphthenic hydrocarbon fluid comprising less than 45% by weight of isoparaffins as a base, fatty substances and sulphur-containing EP additives (sulphur-containing triglycerides) and phosphorus-containing EP additives (triaryl phosphates). Their characteristics and those of commercial fluid G are shown in Table 2 below. The commercial fluid has an isoparaffins content and a VI that are lower than the fluids according to the invention.

TABLE 2

Characteristics of the fluids prepared and commercial fluids for rolling steel

| | A | B | C | D | E | F | G |
|---|---|---|---|---|---|---|---|
| KV 40° C. cSt ASTM | 8.80 | 8.80 | 8.57 | 8.60 | 7.65 | 8.33 | 7.37 |
| KV100° C. cSt ASTM | 2.62 | 2.62 | 2.58 | 2.58 | 2.33 | 2.56 | 2.09 |
| VI ASTM | 139 | 139 | 141 | 140 | 124 | 149 | 71 |
| Density at 15° C., kg/m3 | 837.1 | 837.1 | 837.1 | 837.4 | 836.2 | 837.6 | 849.3 |
| Phosphorus content, ppm (NFT 60-106) | 1324 | 1460 | 1460 | 1550 | 1460 | 80 | 1016/1090 |
| Sulphur content ppm (ASTM D2622) | 0 | 160 | 0 | 200 | 0 | 7500 | 895 |

Example 2

Study of Friction Properties Under Elastohydrodynamic (EHD) Conditions

The friction properties of the fluids described above were studied using an EHD ball-on-disk tribometer. This tribometer is used to measure the friction coefficient as a function of the SRR (slide/roll ratio) applied at a constant drive speed Ve. Using a deformation gauge force sensor the friction coefficient, defined as the ratio between the tangential force or friction force and the normal stress in a steel ball-on-disk contact in the presence of the lubricant under test, is measured. FIG. 2 shows the device and the positions of the sensors.

The test conditions were as follows:

Steel disk, 100 C6 tapped steel ball of diameter 19.05 mm.

Test product: approximately 100 ml of the fluid under test.

Measurement points at 40° C. and 100° C. under a normal stress of 25 N.

Increase in slip speed/rolling speed ratio (SRR %):5-10-20-40-60-80-100% for Ve=1 m/s.

The results of these measurements are shown in Table 3 below:

TABLE 3

Friction coefficients measured on a EHD ball-on-disk tribometer

| | Friction coefficient μ at 40° C. | | | | Friction coefficient μ at 100° C. | | |
|---|---|---|---|---|---|---|---|
| SRR | B | D | F | G (ref) | B | D | F |
| 5% | 0.015 | 0.016 | 0.008 | 0.024 | 0.008 | 0.009 | 0.008 |
| 10% | 0.022 | 0.024 | 0.017 | 0.034 | 0.012 | 0.015 | 0.013 |
| 20% | 0.031 | 0.032 | 0.024 | 0.042 | 0.018 | 0.022 | 0.018 |
| 40% | 0.037 | 0.040 | 0.030 | 0.049 | 0.024 | 0.028 | 0.023 |
| 60% | 0.040 | 0.042 | 0.034 | 0.052 | 0.030 | 0.034 | 0.026 |
| 80% | 0.042 | 0.043 | 0.036 | 0.053 | 0.034 | 0.038 | 0.029 |
| 100% | 0.043 | 0.045 | 0.038 | 0.056 | 0.040 | 0.045 | 0.029 |

The friction coefficients obtained with fluids B and D and F according to the invention are significantly lower than those obtained with the commercial reference identified as G in Table 2. The friction conditions are representative of the entry zone into the rolling mill where the SRR slip ratio varies between some 1 to 5% and approximately 40%. The low friction coefficients obtained with the fluids according to the invention make it possible to displace the neutral point to within the gap when in operation, which makes it possible to increase the reduction in the thickness of the strip per pass, or reduce the number of passes required to achieve a given reduction.

Example 3

Study of Friction Properties Under Limiting Conditions, Cameron Plint

The friction properties of the fluids described in Example 1 were also studied using a Cameron Plint roll-on-flat tribometer representative of conditions under limiting conditions. This tribometer can be used to measure friction coefficients under severe conditions in pure slip.

The test conditions here were as follows:

Moving roll: Diameter 6 mm, length 14 mm (Kors steel)

Sheet on the fixed plane: ferritic or austenitic stainless steel

Travel: 15 mm

Frequency: 20 Hz+1/20 reducer=1 Hz

Load: 100 N and 200 N

Time: over 2400 s

Temperature: 7 plateaux of 4500 seconds at increasing temperatures: ambient, 50-80-110-140-170-200° C.

Volume of oil required: 7 ml

An instantaneous coefficient was measured at the start of each temperature plateau and a mean friction coefficient over the last minute of the plateau. These conditions are representative of friction conditions in the working zone of a rolling mill.

The results of these tests under a load of 100 N and 200 N are shown in Tables 4 and 5 respectively. The absence of any results above a certain temperature indicates than sticking occurred.

TABLE 4

Friction coefficients under a load of 100N on ferritic sheet.

| Mean temperature ° C. | G (ref) | Ref H | A | B | C | D | E |
|---|---|---|---|---|---|---|---|
| 30 | 0.277 | 0.170 | 0.165 | 0.168 | 0.184 | 0.162 | 0.212 |
| 40 | 0.305 | 0.145 | 0.161 | 0.144 | 0.144 | 0.146 | 0.165 |
| 60 | 0.236 | 0.166 | 0.141 | 0.153 | 0.143 | 0.137 | 0.149 |
| 80 | 0.143 | 0.167 | 0.185 | 0.159 | 0.146 | 0.134 | 0.133 |
| 100 | 0.142 | 0.247 | 0.123 | 0.154 | 0.145 | 0.173 | 0.123 |
| 125 | 0.151 | 0.227 | 0.150 | 0.248 | 0.237 | 0.107 | 0.108 |
| 150 | 0.300 | 0.246 | 0.106 | 0.215 | 0.226 | 0.291 | 0.198 |
| 175 | 0.226 | 0.359 | 0.244 | 0.144 | 0.177 | 0.170 | 0.148 |
| 200 | 0.291 | — | — | — | 0.195 | 0.186 | 0.258 |

TABLE 4-continued

Friction coefficients under a load of 100N on ferritic sheet.

| Mean temperature ° C. | G (ref) | Ref H | A | B | C | D | E |
|---|---|---|---|---|---|---|---|
| Mean for T < 100 | 0.240 | 0.162 | 0.163 | 0.156 | 0.165 | 0.145 | 0.165 |
| Mean | 0.230 | 0.216 | 0.159 | 0.173 | 0.166 | 0.166 | 0.166 |

Fluids A, B, C, D, E according to the invention all have lower friction coefficients than the reference commercial products. Their behaviour is particularly favourable for temperatures below 100° C., the domain which most likely correlates with operating temperatures. The surface conditions observed were bright, without colouring or marks.

TABLE 5

Friction coefficients under a load of 200N on ferritic sheet.

| Mean temperature ° C. | Ref G | A | B | C | D | F |
|---|---|---|---|---|---|---|
| 30 | 0.299 | 0.167 | 0.197 | 0.194 | 0.168 | 0.143 |
| 40 | — | 0.147 | 0.145 | 0.145 | 0.160 | 0.124 |
| 60 | — | 0.145 | 0.157 | 0.146 | 0.151 | 0.128 |
| 80 | — | 0.151 | 0.156 | 0.148 | 0.145 | 0.115 |
| 100 | — | | — | — | — | 0.118 |
| Mean for T < 100 | — | 0.152 | 0.164 | 0.158 | 0.156 | 0.128 |
| Time before sticking (minutes) | <1 min30 | 37 min | 34 min | 37 min | 40 min | No sticking |

The fluids according to the invention make it possible to roll without sticking under heavy load while the reference commercial product (G) resulted in immediate sticking.

On austenitic steel the fluids according to the invention result in even lower friction coefficients, although with slightly earlier sticking (see Table 6):

TABLE 6

Friction coefficients under a load of 200 N on austenitic sheet

| Mean temperature ° C. | A | C | D |
|---|---|---|---|
| 30 | 0.134 | 0.129 | 0.156 |
| 40 | 0.120 | 0.115 | 0.117 |
| 60 | 0.106 | 0.111 | 0.118 |
| 80 | 0.114 | 0.119 | 0.119 |
| 100 | — | — | — |
| Mean for T < 100 | 0.118 | 0.118 | 0.127 |
| Time before sticking (min) | 42 min | 37 min | 31 min |

These excellent results suggest that no sticking will occur in service under severe friction conditions representative of the working zone of a rolling mill. Significant reductions in thickness can thus be obtained with a reduced number of passes. The low friction coefficients observed also result in a very bright surface condition (little microsticking) and low sulphur contents (in the case of fluids A to D) which avoid marking the strip through products of the iron sulphide type formed on fresh surfaces.

The invention claimed is:

1. A rolling fluid comprising:

(a) a hydrocarbon base comprising at least 50% by weight of isoparaffins;

(b) one or more friction modifiers selected from fatty alcohols, fatty acids, fatty amines, fatty acid esters, or polymer esters obtained by the esterification of alpha olefin and dicarboxylic acid copolymers by alcohols; and (c) one or more anti-wear and/or extreme pressure phosphorus-containing additives selected from organophosphorus compounds derived from phosphoric acid and/or phosphorous acid, the fluid having a phosphorus content measured according to standard NFT 60-106 at least equal to 500 ppm;

with the condition that when the fluid contains only phosphoric acid derivatives by way of compound(s) (c) it contains at least one sulphur-containing or phosphorus/sulphur-containing compound and its sulphur content measured according to standard ASTM D 2622 is at least equal to 300 ppm.

2. The rolling fluid according to claim 1 in which the hydrocarbon base (a) comprises at least 60% by weight of isoparaffins.

3. The rolling fluid according to claim 1 in which the hydrocarbon base (a) comprises petroleum cuts having an initial and final distillation point between 200 and 400 measured according to standard ASTM D86, and comprising hydrocarbon molecules having between 13 and 25 carbon atoms.

4. The rolling fluid according to claim 1 in which the hydrocarbon bases (a) have an aromatics content of more than 100 ppm and a sulphur content of not more than 1 ppm measured according to ASTM D2622.

5. The rolling fluid according to claim 1 further comprising:

(c) one or more phosphorus- and/or phosphorus/sulphur- and/or sulphur-containing anti-wear and/or extreme pressure additives.

6. The rolling fluid according to claim 1, wherein the sulphur content of which measured according to standard ASTM D2622 is less than 1100 ppm.

7. The rolling fluid according to claim 5 comprising by way of compound (c) one or more organophosphorus compounds derived from phosphoric acid and/or phosphorous acid, the fluid having a phosphorus content measured according to standard NFT 60-106 of at least equal to 500 ppm, with the condition that when the fluid contains only phosphoric acid derivatives by way of compound(s) (c) it contains at least one sulphur-containing or phosphorus/sulphur-containing compound and its sulphur content measured according to standard ASTM D2622 is at least equal to 300 ppm.

8. The rolling fluid according to claim 7 comprising at least one derivative of phosphorous acid by way of compound (c), the rolling fluid having a sulphur content measured according to ASTM D2622 of less than 300 ppm.

9. The rolling fluid according to claim 1, in which the viscosity index measured according to standard ASTM D2270 is higher than 110.

10. The rolling fluid according to claim 1, in which the kinematic viscosity at 100° C. measured according to ASTM D 445 is between 2 and 3 cSt.

11. The rolling fluid according to claim 1, in which the kinematic viscosity at 40° C. measured according to ASTM D445 is between 7.5 and 9 cSt.

12. The rolling fluid according to claim 1 comprising:

50 to 90% by weight of a hydrocarbon base (a);

5 to 20% by weight of one or more fatty substances (b); and from 0.5 to 7% by weight of one or more organophosphorus compounds derived from phosphoric acid and/or phosphorous acid (c).

13. The rolling fluid according to claim 1 comprising 1 to 20% by weight of one or more surfactants.

14. An aqueous emulsion comprising a rolling fluid further comprising:

(a) a hydrocarbon base comprising at least 50% by weight of isoparaffins;

(b) one or more friction modifiers selected from fatty alcohols, fatty acids, fatty amines, fatty acid esters, or polymer esters obtained by the esterification of alpha olefin and dicarboxylic acid copolymers by alcohols; and (c) one or more anti-wear and/or extreme pressure phosphorus-containing additives selected from organophosphorus compounds derived from phosphoric acid and/or phosphorous acid, the fluid having a phosphorus content measured according to standard NFT 60-106 at least equal to 500 ppm;

with the condition that when the fluid contains only phosphoric acid derivatives by way of compound(s) (c) it contains at least one sulphur-containing or phosphorus/sulphur-containing compound and its sulphur content measured according to standard ASTM D 2622 is at least equal to 300 ppm.

15. A method for cold rolling a steel, wherein the steel is brought into contact with a rolling fluid according to claim 1.

16. A method for cold rolling a steel, wherein the steel is brought into contact with a aqueous emulsion according to claim 14.

* * * * *